US005943694A

United States Patent [19]

Moureaux et al.

[11] Patent Number: 5,943,694

[45] Date of Patent: Aug. 31, 1999

[54] SPECIALLY SHAPED MULTILAYER ARMOR

[75] Inventors: Beatrice Moureaux, Bonlieu, France; Friedrich V. Pfister; Nicolas A. Van Zijl, both of Geneva, Switzerland

[73] Assignee: E. I. du Pont de Nemours and Company, Wilmington, Del.

[21] Appl. No.: 09/197,312

[22] Filed: Nov. 20, 1998

Related U.S. Application Data

[63] Continuation-in-part of application No. 08/892,584, Jul. 14, 1997, abandoned.

[51] Int. Cl.[6] ..... F41H 1/02; A41D 13/00

[52] U.S. Cl. ..... 2/2.5; 2/463; 428/911

[58] Field of Search ..... 2/2.5, 455, 456, 2/463, 120; 428/911; 450/30, 31, 92, 93

[56] References Cited

U.S. PATENT DOCUMENTS

| | | | |
|---|---|---|---|
| 2,468,841 | 5/1949 | Siegel | 2/463 |
| 2,662,522 | 12/1953 | Muller | 2/463 |
| 4,183,097 | 1/1980 | Mellian | 2/2.5 |
| 4,578,821 | 4/1986 | Zuffle | 2/2.5 |
| 5,020,157 | 6/1991 | Dyer | 2/2.5 |
| 5,373,582 | 12/1994 | Dragone et al. | 2/2.5 |
| 5,601,895 | 2/1997 | Cunningham | 2/2.5 |

FOREIGN PATENT DOCUMENTS

| | | | |
|---|---|---|---|
| 44 23 194 | 1/1996 | Germany . | |
| 2 231 481 | 11/1990 | United Kingdom | F41H 1/02 |
| WO 96/01405 | 1/1996 | WIPO . | |

*Primary Examiner*—John J. Calvert
*Assistant Examiner*—Larry D. Worrell, Jr.

[57] ABSTRACT

Armor, in particular body armor for female wearers is made of multiple layers (30) of penetration-resistant material for example made of polyaramid fibers, specially shaped to fit over a shaped area to be protected, e.g. the bust of a female wearer. The armor's shaped part is held in shape by a series of darts (37) in successive layers (30) of the material. Each dart in a material layer comprises a generally V-shaped section (35) whose edges (37) are joined to form the dart. The V-shaped section (35) of the material is folded on itself to form a pleat (40) which is folded over to one side of the dart (37) to form an added thickness overlaying or underlying an adjacent part of the material (30). The darts (37) are angularly offset from one another with the pleats (40) oriented in directions so that the added thickness is distributed substantially evenly, thereby avoiding bulges or stiffness and improving the wearing comfort. Preferably, the layers of material are fabric covered over selected areas thereof to be protected with a bonded or coated reinforcing film, except in the folded V-shaped sections.

29 Claims, 8 Drawing Sheets

SPECIALLY SHAPED MULTILAYER ARMOR

RELATED APPLICATION

This application is a Continuation-in-Part of application Ser. No. 08/892,584, filed Jul. 14, 1997 now abandoned.

FIELD OF THE INVENTION

The invention relates to armor made of multiple layers of penetration-resistant material, and is particularly concerned with body armor comprising a part specially shaped to fit over a curved area of the body such as female bust, as well as its method of manufacture.

BACKGROUND ART

It is known to use high tenacity fibers such as polyaramid fibers in multilayer structures to provide ballistic protection in body armor. Bullet resistant vests of multilayer structure have proven very satisfactory as body armor for men and women, but difficulties have been encountered in improving comfort for female wearers by shaping the armor to adapt to the female body.

Wearer comfort and the effectiveness of the armor to prevent injury are closely related. Depending on the protection level and the fabric type, about 10 to 50 layers of fabric are used. This produces a somewhat stiff structure that does not readily adapt to pronounced body contours, particularly over the female breast region. If the armor does not lie in snug contact with the wearer's body, shock transmission becomes uneven and the body armor does not perform as it should. The body armor's shaped areas are particularly liable to damage by shots at a glancing angle of incidence. Moreover, female breasts are specially liable to traumatic shock injury.

Various proposals for multilayer body armor specially shaped to protect shaped areas of the body such as women's breasts have already been made. But making multilayer armor in special shapes is rendered difficult due to the fact that the layers of penetration resistant material are flexible but relatively inelastic. Problems have therefore been encountered.

Contouring a front armor panel by joining cut panels of the fabric with overlapping seams using a special stitching pattern was proposed in U.S. Pat. No. 4,183,097. However, if the overlapping seams are not large enough, angle shots can penetrate the vest, whereas increasing the size of the overlapping seams creates a hard rim in a region where women need as much flexibility as possible.

U.S. Pat. No. 4,578,821 proposed inserting a flexible multilayer ballistic panel into a front pocket of a carrier garment. This panel is held by a VELCRO hook-and-pile fastener enabling adjustment to different bust sizes, but the protected area is limited and the VELCRO fastener cannot ensure good ballistic performance. This system is hence suitable for low protection levels only.

U.K. Patent Specification 2,231,481 proposed a vest whose inner part has a foamed plastic material shaped to fit the breast. A shaped stiff or semi-stiff shock-absorbing sheet is added to the plastic layers and finally a multilayer ballistic pack is inserted, the entire arrangement being enclosed in a bag. With this design, the ballistic pack adapts to the shape by folding about a horizontal line. This can only be achieved by leaving large openings at the left and right sides of the chest, so protection in these side areas will be questionable. Moreover, the vest will be relatively heavy, stiff and uncomfortable to wear.

Another proposal made in U.S. Pat. No. 5,020,157 was the use of rigid, inflexible cups made of high strength laminated polyethylene material which are worn over a woman's breast and under a conventional soft body vest to protect from injuries resulting from ballistic impact. The impact-generated pressure will nevertheless be transmitted to the cup's rim which could cause injury. In addition, the stiff cups will be uncomfortable to wear.

Shaping body armor by molding layers of aramid fabric in a PVC shell with the aid of pressure at 400–800 kPa and heat at 180–300° C. has been proposed in DE-A4423194 and in WO 96/01405. However aramid fibers have an elongation up to 4% which can lead to damage in molding. Moreover, shaping the layers stretches the fabric which would increase the gaps between the fibers and reduce ballistic efficiency. Also, this molding in a PVC shell makes the armor relatively stiff.

The above-discussed prior proposals for specially shaped multilayer body armor have therefore failed to produce a lightweight multilayer structure which fits to the body comfortably while providing excellent ballistic protection and which can be manufactured using available equipment operating at ambient temperature, or using simple thermal bonding techniques.

SUMMARY OF THE INVENTION

An object of the invention is to obviate the above-mentioned problems of the prior art and provide multilayer armor shaped specially to fit over a shaped area, which combines reliable ballistic protection and high comfort and, where required, increased stab protection.

It is also an object of the invention to provide a simple method for shaping such multilayer armor which does not require performance-reducing heat treatment.

These objects are achieved by a novel dart folding technique for building up layers shaped by more-or-less uniformly distributed darts in rotating (angularly offset) sequence, as described below.

The invention proposes armor, in particular body armor, which is made of multiple layers of flexible relatively inelastic penetration-resistant material shaped to fit over a shaped area to be protected.

By "shaped" is meant out-of-plane parts of a three dimensional structure such as a garment.

According to the invention, the layers are held in shape by a plurality of darts in successive layers of the material, each of the layers having at least one dart. Each dart in a layer comprises a generally V-shaped section whose edges are joined to form the dart, with the V-shaped section folded on itself and folded over to one side to form an added thickness overlaying or underlying an adjacent part of the layer.

Also according to the invention, the darts are angularly offset from one another with the folded V-shaped sections oriented so that said added thickness is distributed substantially evenly around the shaped area.

The resulting specially shaped lightweight armor is comfortable to wear without compromising the ballistic protection. The absence of cuts in the darts means that no lines of weakness are created that could allow penetration of projectiles.

The additional thickness of the folded parts of the V-shaped sections, which is distributed substantially evenly around the shaped area, provides extra protective layers over these shaped parts where projectiles are more likely to hit at a glancing angle and cause injury. However, the excellent ballistic protection does not result from these thickened parts, but is due mainly to the fact that the design produces no weaknesses that would reduce the ballistic effectiveness of the main layers.

The shape produced this way enables a better fit to the body contour while imposing no restrictions on the extent of the protection provided by the multilayer structure. Due to their even distribution, the folded-over parts do not adversely affect the flexibility and comfort of the armor. Moreover, the extra weight of the folded parts is insignificant. The body armor thus remains lightweight and comfortable to wear leading to enhanced protection against injury.

The folded V-shaped sections of material form pleats which can all be oriented in the same direction, i.e. folded to the same side. However, usually these pleats are oriented in different directions. In a preferred embodiment, pairs of the layers of material have darts at the same angular location, with their pleats oriented in opposite directions so they do not overlay one another. The layers of material forming these pairs can be adjacent to one another, but are advantageously alternate layers as this improves flexibility and comfort by avoiding jamming of the pleats that could lead to stiffness or bulges.

Angular gaps can be left between the darts where convenient so that corresponding angular gaps may be left between some or all of the angularly adjacent pleats of different layers. This can contribute to the flexibility of the shaped part, without reducing security. What is important is to angularly distribute the pleats in such a way that the extra thickness is evenly distributed, avoiding bulges or stiffness that could reduce comfort and safety.

In principle, the darts extend generally radially from at least one point of convergence. Usually, the darts are angularly staggered from one another around the point of convergence by an angle which is equal to or greater than the angle of the V-shaped sections before folding. This avoids unwanted overlapping of the edges of the folded pleats.

It is understood that the points of convergence of the darts could be distributed around an area of convergence that is not folded, and is sufficiently large to avoid twisting and unwanted "doubling up" at a point of convergence.

Each layer of material normally has one dart, or in the case of women's specially-shaped body armor, two darts arranged symmetrically on either side of the two points or areas of convergence. It is however possible for each layer of material to have more darts, for example four darts on either side of and extending above and below the two points or areas of convergence.

A main application of the shaped armor of the invention is as body armor comprising at least one part shaped to fit over a shaped part of the body such as a torso, a neck and/or collar area, a shoulder area, or an elbow, knee or other joint area. The body armor can be soft or relatively stiff or hard armor in the form of vests or arm or leg protection and similar apparel.

A particular application is as body armor shaped to fit over the bust of a female wearer, having two laterally-spaced internally concave recessed parts corresponding to the bust. In this embodiment, the darts are angularly offset around each of the two laterally-spaced recessed parts about which said added thickness is distributed substantially evenly.

In this women's shaped body armor, the two laterally-spaced concave recessed parts corresponding to the bust are usually formed by darts around the upper, lower and outer edges of the recessed parts, defining a continuously shaped bust ("mono-cup") receiving the two breasts.

Alternatively, two breast cups can be provided, but this is not necessary. In this case, it would be possible to provide enough darts angularly staggered from one another so that the pleats cover substantially an entire circular area around each laterally-spaced recessed part.

The darts of this women's shaped body armor extend radially from two laterally-spaced points or areas of convergence corresponding to the centers of the recessed parts, above and below the two points or areas of convergence, and preferably extending over an angle of at least about 180 degrees.

Body armor according to the invention in the form of a vest typically has front and rear panels permanently joined together or releasably secured for example by VELCRO fasteners, the front panel for example being shaped to fit over the bust of a female wearer by the described novel arrangement of darts. The invention concerns both the entire vest and the front panel, which may be sold separately.

The angle of the V-shaped sections of flexible material depends on the degree of curvature required for any particular application. For most applications, the V-shaped sections will each make an angle of about 10 to 40 degrees.

For women's shaped body armor, an angle of about 15 to 30 degrees, conveniently 20 to 25 degrees, is preferred as this provides the recessed parts with a shape that is suitable for most female breasts.

V-shaped sections having an angle less than 10 degrees are possible for neck shapes, for example. When small angles are employed, special care will be taken to properly fold and position the relatively narrow pleats (half the angle of the V) to avoid creating bulges.

V-shaped sections having an angle more than 40 degrees may be needed for elbow shapes, for example.

Usually, the assembled layers of material have at least three dart locations about each of the two laterally-spaced recessed parts. However, for some applications, two dart locations may suffice, wherein the pleats in different layers at each dart location are folded in opposite directions to spread the extra thickness of the pleats as much as possible.

An arrangement with six dart locations about each of the two laterally-spaced recessed parts has proven very satisfactory for women's vests. The maximum number of dart locations will be determined by the envisaged application and by manufacturing considerations.

The shape produced by the special arrangement of darts according to the invention can be symmetrical or asymmetrical about one or more points or areas of convergence. An asymmetric shape can be provided by an asymmetric distribution of the dart locations, and/or could involve using V-shaped sections (in the same or different layers) having different angles, or by asymmetric folding of the pleats.

As discussed in detail below, the penetration-resistant material is advantageously made of polyaramid fibers and, to improve the penetration resistance and reduce backface deformation, one or more of the layers (typically only the back and/or front layer) may be bonded to a polymer. It is also possible for the body armor to include one or more front pockets for receiving ballistic panels, or to be associated with other protective layers, to improve the ballistic performance and/or reduce back-face deformation where needed. For example, a rigid or semi-rigid front layer could be fitted.

Generally, a plurality of the layers of penetration-resistant material can each comprise a fabric bonded to a reinforcing continuum such as a polymeric film or coating layer, a metal foil or a sheet of rubber or elastomer.

Depending on the elastic modulus of the reinforcing resin and the thickness of the single layer, in certain cases such laminated or coated fabric could not be used for forming female vests, mainly because the folding of laminated or coated fabrics leads to sharp and hard edges which make the vests uncomfortable to wear and detract from their ballistic efficiency. With an increasing number of brittle coatings, the function of the anti-stab or trauma reduction may diminish instead of increasing.

Consequently, one embodiment of the invention is contemplated where a multilayer structure has only a limited number of extra-reinforced layers—say three or four layers out of 10 to 50 layers in all—thereby improving the penetration resistance without leading to a problem of bulging in the area of the darts.

In a preferred embodiment of the invention, described in greater detail below, the multilayer structure comprises composite selectively coated layers made of a fabric of penetration-resistant fibers provided with a reinforcing continuum which extends over a selected area to be protected of these layers, except the V-shaped sections forming the darts, the folded-over V-shaped sections consisting of fabric only.

These layers with a selectively-applied reinforcement can be placed at the back or at the front of the multilayer structure, or all of the layers making up the multilayered structure can be selectively reinforced in this way. Alternatively, the selectively-reinforced layers can be interleaved between alternate layers or packages of layers of non-reinforced penetration-resistant fabric.

If wanted, extra layers of elastic material can also be interleaved between the shaped layers according to the invention. Also, at least two successive layers of penetration-resistant material can be glued or bonded together as a sandwich, for example bonded by a reinforcing polymer.

THE PENETRATION-RESISTANT MATERIAL

Various types of fibers can be applied in the penetration-resistant material used in the multilayer body armor according to the invention such as fibers comprising a polyolefin, e.g. polyethylene, polyimide, polyester or polyaramid usually having a tenacity at least 900 MPa according to ASTM D-885, which equals approximately 7 grams/denier. To provide superior penetration-resistance, preferably the tenacity of the fibers is at least 2000 MPa according to ASTM D-885.

Polyaramid fibers are preferred because they can have the required tenacity, even surpassing the preferred 2000 MPa limit and, in addition have good chemical resistance.

The fibers can be present in the material in many forms, preferably as a knitted fabric, a woven fabric, as a uniweave structure, unidirectional structure or multi-directional sheet (e.g. having fibers crossing over at an angle between 20 and 90 degrees) or as a non-woven (e.g. felt) layer. Film-like sheets of penetration-resistant material are also possible.

For reasons of manufacturing efficiency, availability and geometric strength (well defined stable structure) a woven fabric of high tenacity fibers is preferred. The fabric construction can suitably be a plain weave made up typically from 42×42 or 28×28 ends/cm, or 14×14 or 6.7×6.7 ends/cm, although other woven structures can equally well be used, depending on the use requirements.

The specific weight of such fabrics is generally from 0.02 to 0.5 kg/m$^2$, preferably from 0.05 to 0.5 kg/m$^2$ and more preferably from 0.08 to 0.3 kg/m$^2$ in order to obtain a balance between penetration resistance and specific weight.

If the specific weight below is 0.02 kg/m$^2$ the ballistic resistance of the fabric, even when made from polyaramid fibers, is generally unacceptable whereas if the specific weight is above 0.5 kg/m$^2$, the use of a plurality of fabric layers becomes impractical, due to weight constraints.

The fibers used have a suitable denier number (defined as the weight in grams of 9000 meters of yarn) from 0.1 to 3500, and suitably from 10 to 3500, depending on the required fabric weight/ballistic performance ratio. A fiber with a denier from 1000 to 3000 is used for less demanding applications, while for high performance/low specific weight applications, a fiber with a denier from 1 to 1000, and more particular from 50 to 1000 is preferred.

In many cases, a denier range from 1 to 3000 for the fibers is excellent.

The fibers can be present in uncoated form, or coated or otherwise pretreated (e.g. pre-stretched or heat-treated). In case polyaramid fiber is used, it is generally not necessary to coat or otherwise pre-treat the fiber other than arranging it in the appropriate woven or non-woven layer; however, in some cases a coating might be applied to the fibers for example in order to increase their bonding to a polymeric continuum.

To improve the penetration resistance and reduce back-face deformation, one or more of the layers of the above-described fabric may be bonded to a polymer layer or impregnated with a polymer in order to make use of both the properties of the fibers and the polymeric continuum. For example, several or all of the layers can have a bonded or coated reinforcing layer over a selected area, excluding the area of the darts.

Such a composite described in International Publication No. WO 97/21334, published Jun. 12, 1997, includes a layer composed of fibers having a tenacity of at least 900 MPa (7 g/denier) according to ASTM D-885 bonded to a polymeric continuum having a flexural modulus of 42 to 1,000 MPa according to ASTM D-790, a tensile strength at break of at least 10 MPa according to ASTM D-638 and an elongation to break of at least 100% according to ASTM D-638.

In such composites, preferably a thermoplastic polymer is used. Suitable polymers include specific polyethylenes, polyimide, polyether etherketone, ionomeric resins, phenolic-modified resins, polyesters.

The thermoplastic polymer is for example, an ionomeric resin containing cations selected from the group consisting of Lithium, Sodium and Zinc, in particular from 0.1 to 3% by weight of such cations.

Alternatively, the thermoplastic polymer is a phenolic modified resin, in particular a phenolic-polyvinylbutyral resin.

The polymeric continuum should preferably have a tensile strength at break of at least 20 MPa and an elongation to break of at least 200%, more preferably at least 300%, both according to ASTM D-638.

The flexibility of the polymeric layer is an important factor for both the penetration-resistance of the composite and the wearing comfort of body armor incorporating one of more of the composite sheets.

The flexural modulus of the polymer is preferably between 42 and 1000 MPa, according to ASTM D-790, in particular between 50 and 800 MPa.

A flexural modulus higher than 1000 MPa indicates a polymer that is too stiff to effectively withstand puncture or be worn comfortably as body armor, whereas a flexural modulus of less than 42 MPa indicates a material which is too flexible to provide any effective stiffness to the composition for anti-stab purposes. An additional advantage of body armor comprising such a polymer is the reduced backface deformation attained when a bullet hits the body armor.

Another significant property of the polymer layer is the density thereof, in particular in view of a desirable low specific weight (expressed in $kg/m^2$ composite) for ease of wear of body armor and for ease of handling and efficient engineering with the aim of weight reduction.

Preferably the density of the layer comprising the polymeric compound is below 2,500 $kg/m^3$, and in particular below 1,500 $kg/m^3$; ionomeric polymer layers are particularly preferred in this respect if their density is less than 1,000 $kg/m^3$.

The polymeric continuum can be suitably applied as a layer which can be bonded at one side or at both sides to a fiber-containing layer, depending on the application, and in more practical terms, on the availability of the appropriate manufacturing process. In a preferred embodiment, the fiber-containing layer is embedded in the polymeric continuum in order to immobilize the fibers, resulting in an extremely strong composition.

The polymer can be applied as a pre-formed film, or can be formed as a coating layer on the fibers, or partly or fully impregnated in the fibers, by spraying, roller-coating, painting, dipping or other means.

The polymer and fiber layers can be bonded in a batch or continuous process, by any means known in the art, such as calendering, extrusion coating, gluing, impregnation, thermally bonding, other forms of laminating layers of two different materials, or even in-situ polymerization thus forming a polymer continuum with the fibers.

A preferred method of bonding a fiber/polymer composite layer is thermal bonding such as molding in the form of a batch process, or in the form of a continuous process, in particular by means of a belt press or calender.

When layers of such composite fiber/polymer are included in the shaped body armor according to the invention, such sheets can be shaped using darts and folded pleats as described herein; there is no need for the application of heat during this shaping process. However, it would be possible to include one or more layers of a fiber/polymer composite pre-shaped by molding.

SELECTIVELY COATED COMPOSITE LAYERS

In a preferred embodiment of the invention, several or all of the layers are made of a fabric of penetration-resistant fibers coated with or bonded to a reinforcing continuum which extends over a selected area to be protected of these layers, with the exception at least of the V-shaped sections which are folded over to form darts, these V-shaped sections consisting of fabric only.

These V-shaped fabric parts can be easily folded into darts and sewn, if required. In some embodiments, the reinforcement extends over substantially the entire area of the layer except the V-shaped sections folded into darts. Other parts of the layer can also be left uncoated, for instance several centimeters around the periphery can be free of the reinforcing material to facilitate sewing together of successive layers.

If extra protection is needed only in some areas, the reinforcing continuum can be applied selectively to those areas, leaving the V-shaped section free. Typically the extra reinforcement will usually extend over all or parts of the shaped area where protection is needed most. For instance, for a vest shaped to fit a female bust, the extra reinforcement could cover the shaped part of the bust.

The V-shaped discontinuities in the reinforcing continuum facilitate folding of the darts in the corresponding V-shaped parts of the fabric. In the finished armor, these discontinuities are covered by the folded over layers of the fabric forming the darts. The angular offsetting of the darts distributes both the darts and the discontinuities in the reinforcing continuum of the different layers around the shaped area, avoiding bulges and excessive stiffness.

In this way, several or all of the layers can be reinforced without leading to problems of bulging or excessive thickness in the area of the darts. As in the other embodiments, the ballistic protection level in the shaped area will be increased due to the additional folded layers.

This embodiment is particularly applicable to front panels of female vests with improved ballistic protection and stab resistance combined with great wearing comfort and ease of manufacture.

Such selectively-applied layers can be laminated (as described above) or coated. The V-shaped areas can be cut out from the film before laminating and molding. Alternatively, the V-shaped areas of the fabric can be covered with, for example, a sheet of PTFE and, after molding, the part of the film which does not stick to the fabric in this V-shaped area can be removed.

Coating can be done with different resins, for example aqueous solution of an ionically neutralized copolymer of ethylene and methacrylic acid such as that available as SURLYN® solution, SURLYN is a trademark of DuPont. Other possible resins are disclosed in patent specification UK-A-2,304,350. The resin can be applied for example by brush, pistol or dipping. If dipping is used, the V-shaped areas and any other areas of the fabric which should not be coated will be pretreated with wax or another suitable repellent.

The composite layers, which require curing under moderate heat and pressure, can thus be produced before shaping the layer by folding and stitching the darts in the V-shaped areas. In another method, the darts could be folded, the coating material applied, then the darts unfolded, the layer cured in a flat press, then the darts refolded and stiched and the layers assembled. In both cases, curing can be done in a flat press and therefore does not require expensive molding equipment and process steps, as in the prior art.

Alternatively, the darts could be folded and stitched before applying the reinforcing continuum, in particular using a coating material which does not have to cure under heat and pressure. Also, a material, such as a two-component glue, which cures at room temperature could be applied to layers with stitched darts to form a protective coating.

METHOD OF MANUFACTURE

According to another aspect of the invention, a method of manufacturing multilayer specially-shaped armor begins by providing multiple layers of flexible relatively inelastic penetration-resistant material to be assembled into the shaped armor. Each layer has fold lines defining at least one dart comprising a generally V-shaped section of the material, the darts of the different layers being angularly offset from one another around at least one point or area of convergence.

Firstly, the edges of the V-shaped sections are joined to form the darts in each layer, the layers with formed darts all having substantially the same peripheral shape for assembly into the body armor.

Usually, all of these layers are identical in shape and size. However, sometimes it may be convenient to arrange the layers with slightly different shapes or sizes, for example in order to accommodate for progressive shaping as the layers build up.

Then the multiple layers are assembled to form the shaped part with the darts of different layers angularly offset to one another and with the V-shaped sections of material folded in directions to distribute the added thickness substantially evenly around the shaped part.

This forming operation is carried out on a suitable support. To form a vest for example, the layers can be built up on a bust.

Lastly, the thus-shaped multiple layers are assembled to form the armor.

The gradual build-up of angularly offset ("rotated") darts with folded pleats in the progressive layers (from layer number 2) can be referred to as progressive contouring, as the contouring progresses during the subsequent layers up to 30, 50 or even more layers.

In this way, armor can be tailored by building it up in anatomically correct fashion. Each single layer of relatively inelastic penetration-resistant material can be shaped by folding, joining the dart, folding the pleat and building up the successive layers.

Alternatively, it is possible to pre-assemble several layers, then fold the darts of the individual layers, or fold a single dart from several layers (usually only two to six), to shape the assembly.

On the one hand, it is possible to tailor garments such as vests to the measurements of individual wearers. On the other hand, shaped garments such as vests can be made so they can be adapted to fit different wearers.

The folding and fastening technique does not require special equipment or tools, but can be handled by existing procedures of modem textile cutting techniques.

An advantage of this assembly technique is that multi-layer shapes can conveniently be made using relatively thin layers of the penetration-resistant material built up to a very large number of layers, say 50 layers or more. It is well known that the ballistic performance improves with the number of layers, even for the same overall thickness.

Preferably pairs of the layers of material have darts at the same angular location, and the V-shaped parts of these layers are folded in opposite directions so they do not overlay one another, the pairs of layers with darts at the same angular location preferably being assembled in alternate layers.

By this novel technique of building thick protection layers, layers are gained (at overlaps where the pleats are folded over) that provide additional protection against ballistic impact, valuable especially at shaped areas where bullets or fragments hit at an angle (non-perpendicular impact).

The edges of the V-shaped sections can be sewed together to form the darts, preferably using a polyaramid yarn. Alternatively, these edges could be joined by other means such as staples or rivets of polyaramid, or by gluing. The layers of impact-resistant material are conveniently joined by sewing.

When the layers of material are attached together, care is taken to maintain the shape and to avoid the formation of air pockets. The front panel of the body armor can be made by joining together two or more packs of layers of the penetration-resistant material shaped by assembling layers with angularly offset darts as just described.

The same techniques can be used to assemble composite layers of penetration-resistant fabric bonded to or coated with a reinforcing continuum in selected areas except in the V-shaped areas for forming darts. The reinforcing continuum can be applied to the fabric, with the application of heat and pressure, before folding the darts. Alternatively, the reinforcing continuum is applied to the fabric after folding of the dart(s).

BRIEF DESCRIPTION OF THE DRAWINGS

The invention will be further described by way of example with reference to the drawings, wherein:

FIGS. 2-1 to 2-12 are schematic plan views each showing one half of one layer of material, the twelve layers of FIGS. 2-1 to 2-12 being shown before assembly of the successive layers to form the shaped front panel of the bullet-resistant vest of FIG. 1;

FIG. 3 illustrates the formation of a dart in one of these layers;

FIGS. 4-1 to 4-4 illustrate folding of the darts of four successive layers before (or during) assembly of the layers;

FIG. 5 is a schematic plan view illustrating the angular distribution of the folded pleats;

FIG. 6 is a schematic plan view illustrating how the back panel of the body armor of FIG. 1 may be assembled; and FIG. 7 is a view corresponding to FIG. 2-1, showing a modified type of layer backed with a reinforcing film over only a part of its surface.

DETAILED DESCRIPTION

Figure 1:
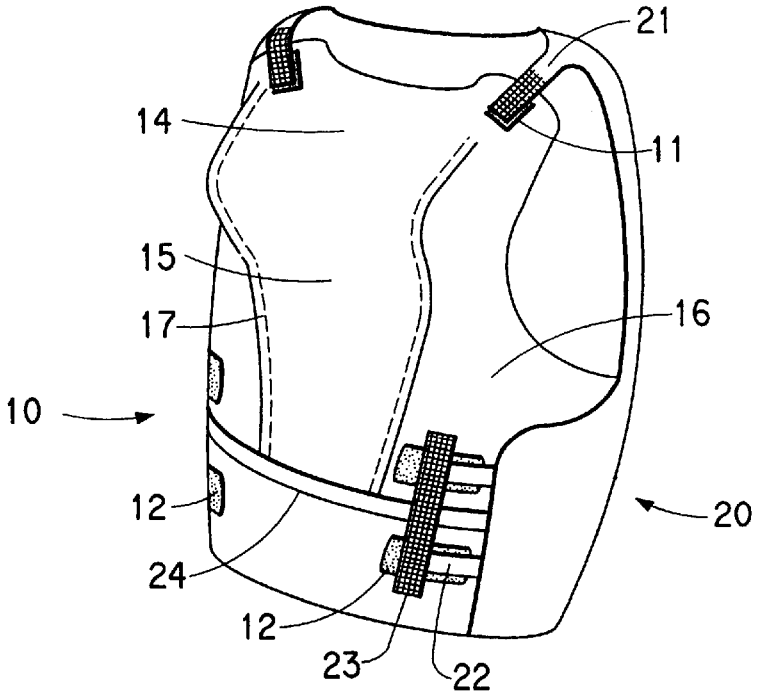
FIG. 1 is a front perspective view of a bullet-resistant vest having a front panel shaped according to the invention for the vest to be worn by a female.

FIG. 1 shows a lightweight bullet-resistant vest comprising a front panel 10, which is shaped to fit over the bust of a female wearer, and a back panel 20, each made from an assembly of layers of penetration-resistant material. The front panel 10 has a top breast section 14 and a lower breast section 15 shaped to form inside two laterally-spaced internally concave recessed parts corresponding to the bust. The internal layers of penetration-resistant material making up the front panel 10 are shaped by a series of angularly-offset darts, as will be described with reference to FIGS. 2 to 4.

As shown in FIG. 1, the front and back panels 10,20 of the vest are releasably secured together by a series of VELCRO fasteners, namely pile fasteners 11 at the top sides of front panel 10 that cooperate with hook fasteners carried by shoulder straps 21 fitted to back panel 20, and pile fasteners 12 at the bottom sides of front panel 10 that cooperate with hook fasteners carried by side straps 22 fitted to the lower part of back panel 20. These side straps 22 carry an additional VELCRO cross-piece 23 and, for added security, a belt 24 with VELCRO fasteners is provided.

The layers of penetration-resistant material making up the front panel 10 are enclosed between an outer cover sheet and a lining of non-penetration-resistant material. To conform this outer sheet to the shape of the front panel 10, seams 17 which extend up to and over the level of the bust are provided. However, it is emphasized that according to the invention the inside layers of penetration-resistant material have no cuts, but are assembled by a series of angularly-offset darts having folded pleats, as described below with reference to FIGS. 2 to 4.

If desired, the outside cover sheet can have a dart with a folded pleat, like those of the inside layers of penetration-resistant material.

FIGS. 2-1 to 2-12 each show the right-hand half of one of twelve layers 30 of penetration-resistant material before assembly of the successive layers to form the shaped front panel 10 of the bullet-resistant vest of FIG. 1. The other half of each layer 30 is a mirror image about the line X. The lines shown inside the perimeter of each layer 30 are only indications serving to locate the folding and joining lines.

Each layer 30 has two side extensions 31 (corresponding to the parts of the front panel 10 that fit around the wearer's waist), side recesses 32 (corresponding to the parts of the front panel 10 that fit under the wearer's arms), rounded upper parts 33 (corresponding to the parts of the front panel 10 that cover the wearer's upper breast, i.e. where the fasteners 11 are attached), and a concave top 34 (corresponding to the part of the front panel 10 that fits around the wearer's neck).

Figures 1, 2:
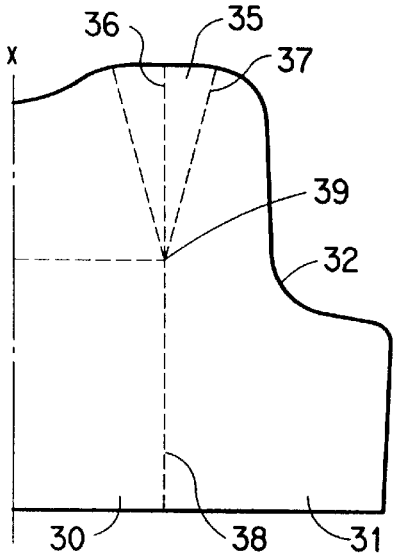
Figure 2:
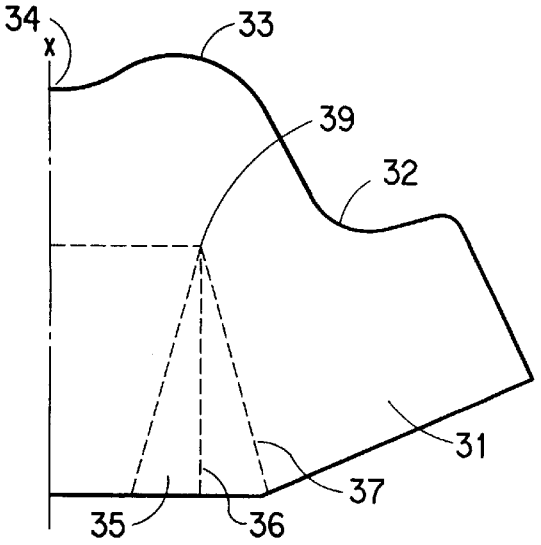
Figures 2, 3:
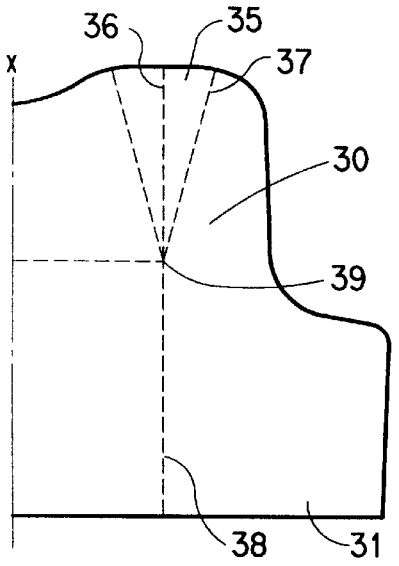

Each half of the layer 30 also has a V-shaped section 35 having a central fold line 36 about which it can be folded and joined to form a dart as illustrated in FIG. 3. This Figure shows a layer corresponding to that of FIG. 2-1 or FIG. 2-3. As shown, the layer 30 is folded about a vertical fold line 38 coincident with the fold line 36, whereupon the layer 30 can be joined by sewing or stapling along the lines 37 defining the V-shaped section 35, to form a dart along the joined lines 37, leaving a pleat 40 which consists of the V-shaped section 35 folded over on itself.

Figures 2, 3, 4:
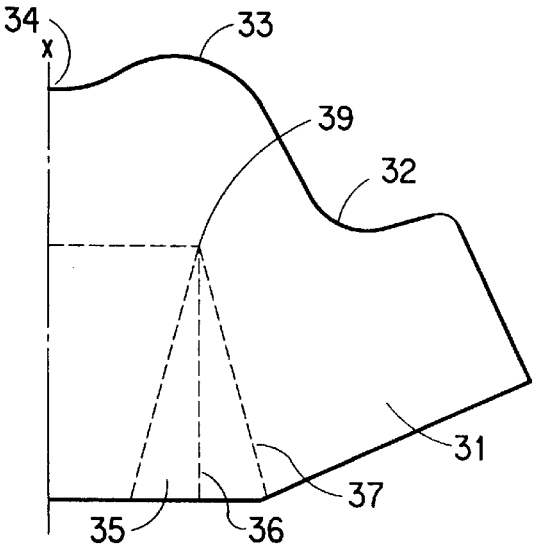
Figures 2, 3, 4, 5:
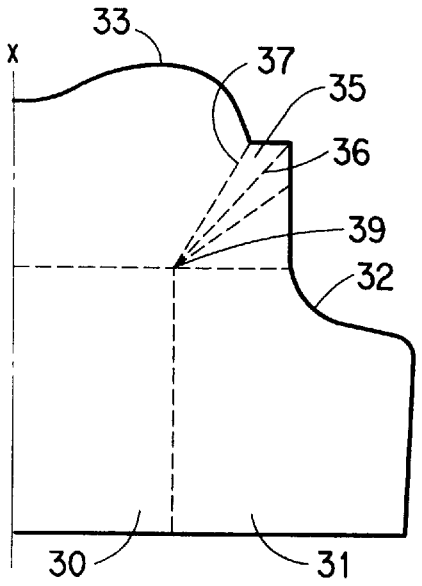

As shown for the layers 30 of FIGS. 4-1 to 4-4, when two darts 37 are formed in the right and left parts of each layer 30, the outer perimeter of the layer 30 adopts a shape which is essentially the same for all of the layers and corresponds to the peripheral shape of the front panel 10. The successive layers 30 can however have different sizes and shapes as a function of the shape to be built up.

By comparing FIGS. 2-1 to 2-12, it can be seen that the successive layers have darts 37 which are angularly offset from one another around a point of convergence 39, each sheet 30 having two laterally-spaced points of convergence 39 corresponding to the centers of the recessed parts in the front panel 10 that are adapted to receive the wearer's breast. These points of convergence 39 are approximately at the same locations for all twelve layers 30. It is understood that the pointed ends of the darts 37 could be distributed around an area of convergence, e.g. a circular area that as a result is not folded. Such area will be sufficiently large to avoid twisting and unwanted "doubling up" at a point of convergence.

Alternate pairs of the layers 30 of material—namely those of FIGS. 2-1 and 2-3; 2-2 and 2-4; 2-5 and 2-7; 2-6 and 2-8; 2-9 and 2-11; 2-10 and 2-12—are identical so the darts 37 of the layers of each pair are located at the same angular location. The darts 37 of the successive layers (FIGS. 2-1, 2-2, 2-3 and so on) are angularly offset to one another. Those of FIGS. 2-1, 2-2 and FIGS. 2-3, 2-4 are at 180 degrees to one another; those of the other successive layers are at different angles represented on FIGS. 2-5 to 2-12 by the fold lines 36. Generally, the darts 37 in the odd-numbered layers are located on the upper part and those in the even-numbered layers are located on the lower part of its layer 30, except for the layer 30 of FIG. 2-10 where the dart is located in the middle.

In this given example, the angle of the V between the lines 37 forming each dart is about 22.5 degrees, so the six darts placed side by side would extend over 135 degrees. However, it can be seen that overall the darts 37 extend over an angle of about 195 degrees, starting at one extremity at the top from the darts 37 of FIGS. 2-9 and 2-11, to the darts 37 of FIGS. 2-2 and 2-4 at the other extremity at the bottom, there being a gap between the other darts 37—see FIG. 5.

As illustrated in FIGS. 4-1 to 4-4, the pleats 40 associated with darts 37 are folded in alternate directions in order to achieve the best possible distribution of their extra thickness when the layers 30 are assembled. Each pleat 40 occupies ½ the width of the V-shaped sections and these pleats 40 are selectively folded in alternate directions.

In FIG. 4-1 the left pleat 40 in the top of the first layer 30 is folded to the right and the right pleat 40 is folded to the left. Likewise, in FIG. 4-2, the left pleat 40 in the lower part of the second layer 30 is folded to the right and the right pleat 40 is folded to the left.

For the corresponding next two layers of FIGS. 4-3 and 4-4, the folding of the corresponding pleats 40 is inverted, i.e. for the third and fourth layers 30 the left pleats 40 are folded to the left and the right pleats 40 are folded to the right.

The same pattern of inverting the folding of the pleats 40 is followed in the subsequent groups of pairs of layers 30. The principle is that the pleats 40 in darts 37 located at the same location in alternating layers—like those in FIGS. 2-5 and 2-7 and in FIGS. 2-6 and 2-8 for example—will be folded in opposite directions so that when the layers 30 are assembled these pleats 40 will not overlay one another (see FIG. 5). This folding of the pleats 40 can be done when the darts 37 are formed, or when the layers 30 are being assembled.

The layers 30 with their darts 37 are then assembled successively on a bust, with the pleats 40 of the successive layers folded as described above. Each layer 30 is adjusted onto the next (or previous) one by means of needles. The same process is repeated for all twelve layers 30, laying the pleats 40 in the selected directions on top of the layer 30, except for the last layer where the pleats can be turned inside to have a smooth outer surface.

The assembled and shaped layers 30 are held in clamps and sewed (or otherwise secured together) around their periphery, taking care to maintain the shape during sewing and pressing out air to avoid the formation of air pockets. For this, it is preferable not to sew continuously around the periphery, but to sew peripheral sections one at a time, starting at the rounded upper parts 33 and finishing at the lower corners. If desired, the part corresponding to the waist can be taken in to provide a better shape.

Thanks to the darts 37, the assembled layers 30 are shaped to form two laterally-spaced recessed parts in a mono-cup configuration adapted to fit over the wearer's breasts, and the pleats 40 in the various layers 30 are oriented in directions so that the added thickness is distributed substantially evenly around the shaped parts, avoiding any bulges or stiffness.

Figure 5:
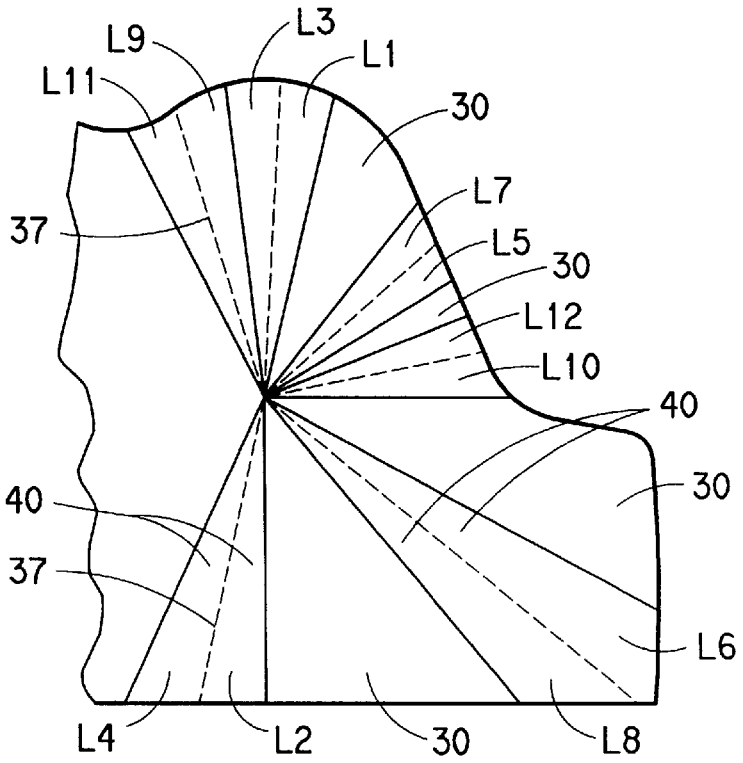

FIG. 5 schematically illustrates the angular distribution of the pleats 40 in the assembled pack. In this Figure the pleats 40 are identified by the number L1 to L12 of their respective layer 30 corresponding to FIGS. 2-1 to 2-12. In this example, proceeding clockwise, the pleats L11-L9, L3-L1, L7-L5, L12-L10, L6-L8 and L2-L4 are arranged together in pairs folded in opposite directions about the lines forming their darts 37. The pleats L1-L7, L5-L12, L10-L6 and L8-L2 are all angularly spaced apart from one another by expanses of the layer 30 that are not covered by pleats.

Due to the angular staggering of the darts 37 and the selective orientation of the pleats 40, no pleats in the pack overlap one another. Moreover, pleats 40 whose external edges coincide angularly with one another—in this example L3 and L9—are separated by a non-pleated part of at least one intermediate layer 30—namely layers L4-L8—so there is no risk of interference between pleats 40 that could cause jamming or bulge formation.

In the final assembly, the pleats 40 are evenly distributed around the outer parts of the mono-cup recesses, providing two extra protective layers in this sensitive zone in the locations covered by the pleats 40.

If it is desired to have two extra protective areas over the uncovered areas in FIG. 5, this can be achieved simply by including extra layers in the pack with darts at the desired extra locations.

The front panel 10 of FIG. 1 can be made by fitting together a chosen number of packs of the twelve layers 30 assembled as described, e.g. two packs making up a 24-layer panel or three packs making up a 36-layer panel, and so on. It is also possible to make fractional assemblies, e.g. two and a half packs making up a 30-layer panel.

Figures 2, 3, 4, 5, 6:
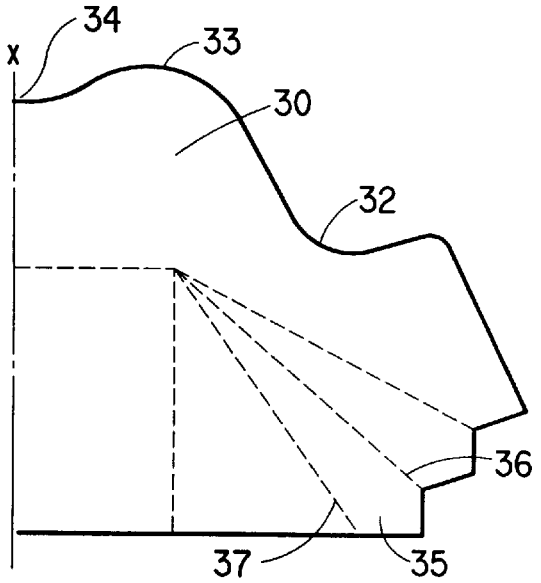

FIG. 6 shows how layers of penetration-resistant material can be assembled to form the back panel 20 of FIG. 1. Here, layers 50 shaped to form the back panel 20 are placed together, curved to the back's shape then sewn or otherwise attached together. All layers 50 except the last five are sewed together around their periphery at 51 and crosswise at 52. The last five layers 50 (which will be those closest the body) are sewed together only around the periphery at 51. Then the packs are stitched together only in the top and side regions of the periphery 51.

The front and back panels 10,20 are then enclosed in their respective cover layer and lining, and the VELCRO fasteners and straps fitted.

Figures 2, 3, 4, 5, 6, 7:
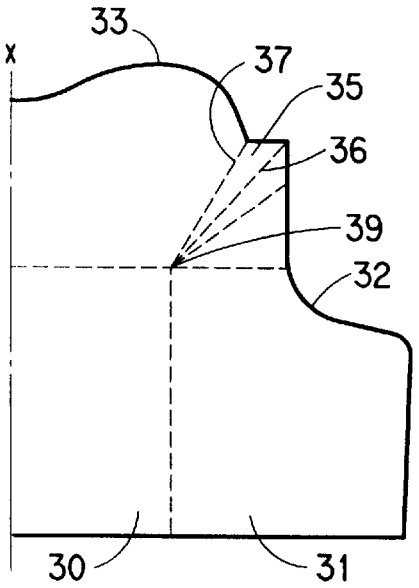
Figures 2, 3, 4, 5, 6, 7, 8:
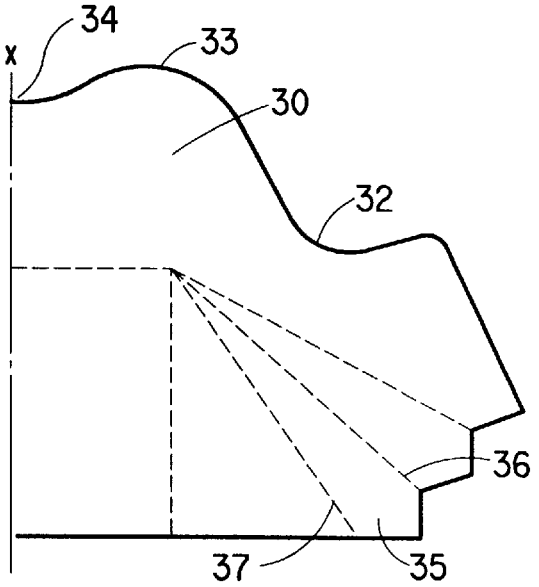
Figures 2, 3, 4, 5, 6, 7, 8, 9:
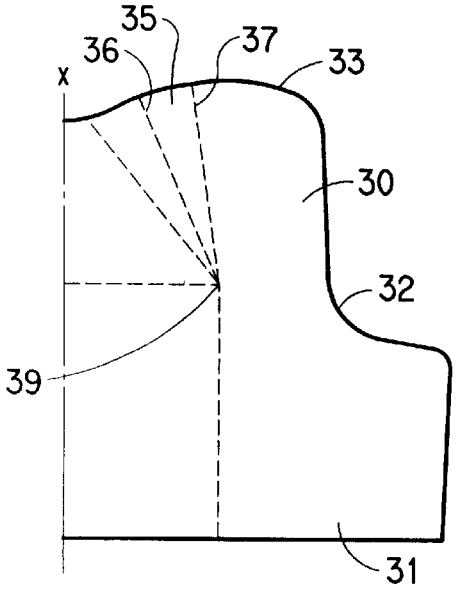
Figures 2, 3, 4, 5, 6, 7, 8, 9, 10:
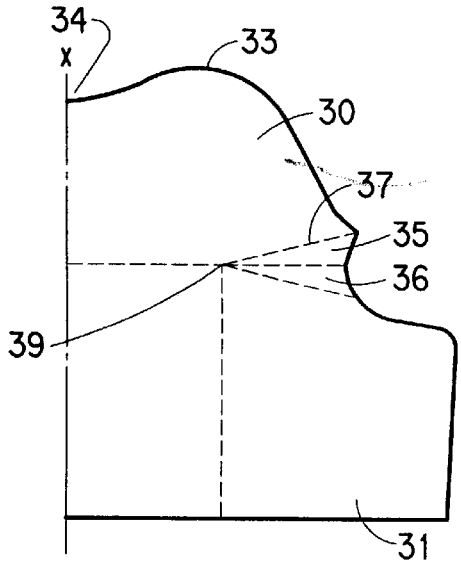
Figures 2, 3, 4, 5, 6, 7, 8, 9, 10, 11:
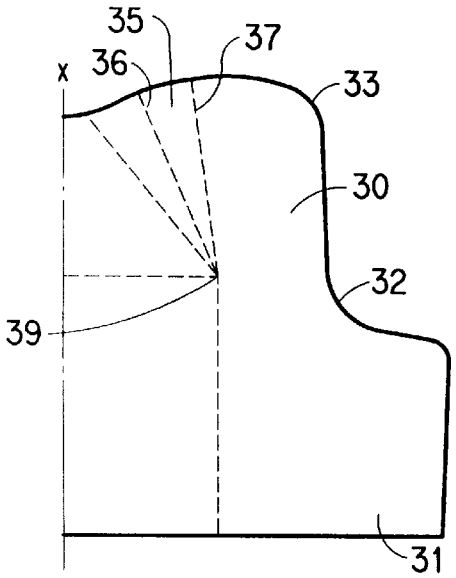
Figures 2, 3, 4, 5, 6, 7, 8, 9, 10, 11, 12:
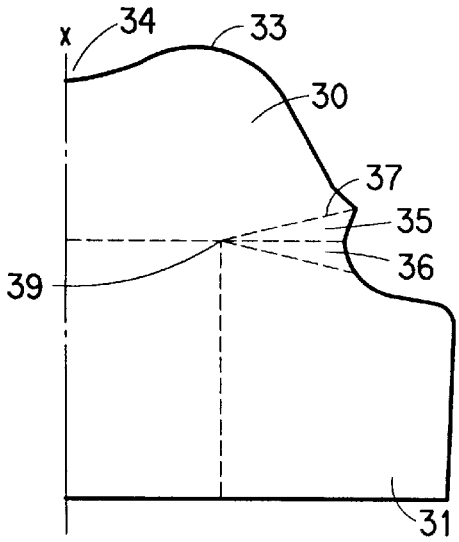
Figure 3:
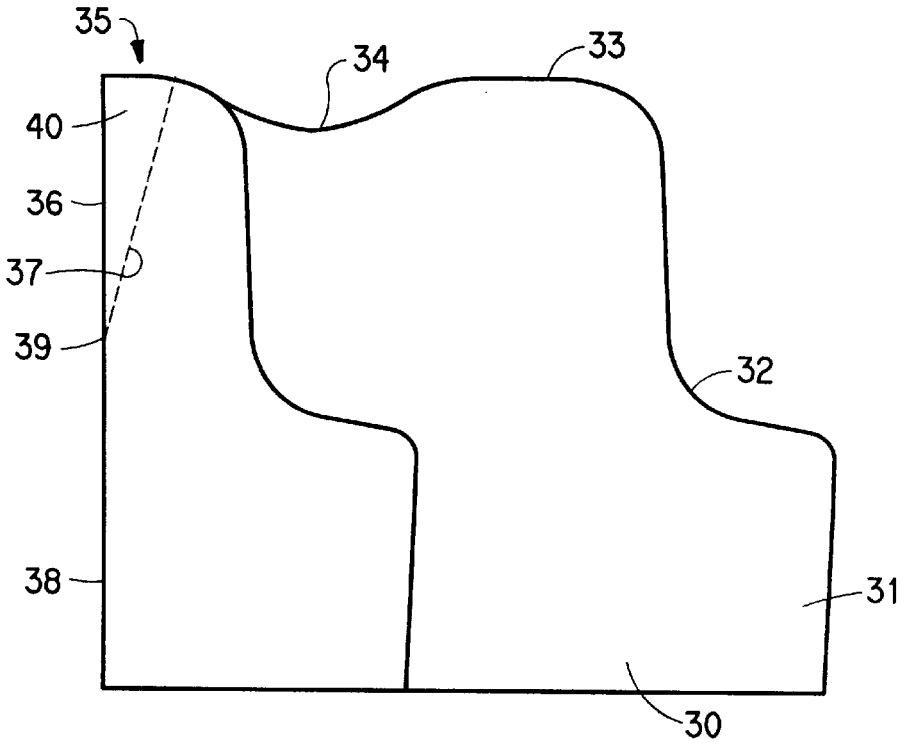
Figure 6:
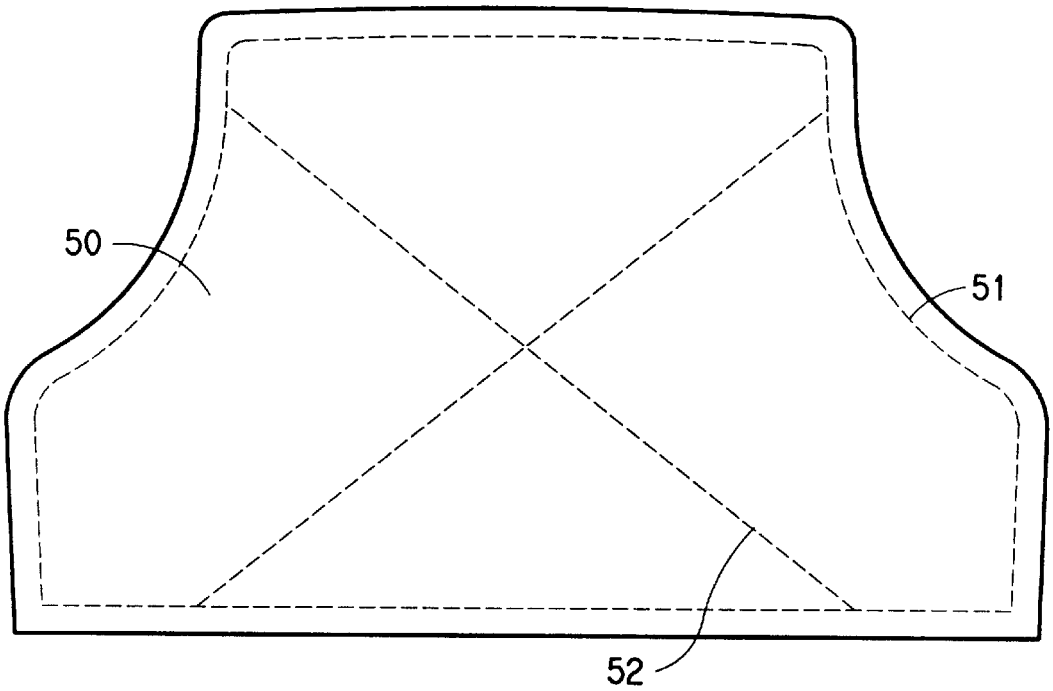
Figures 1, 4:
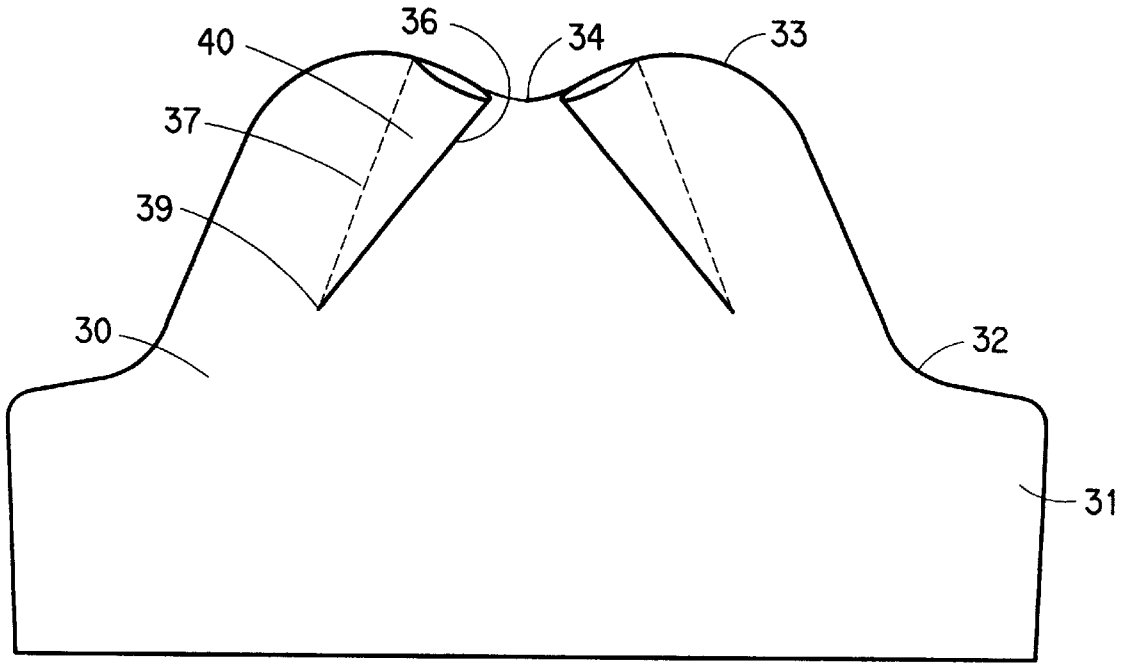
Figures 2, 4:
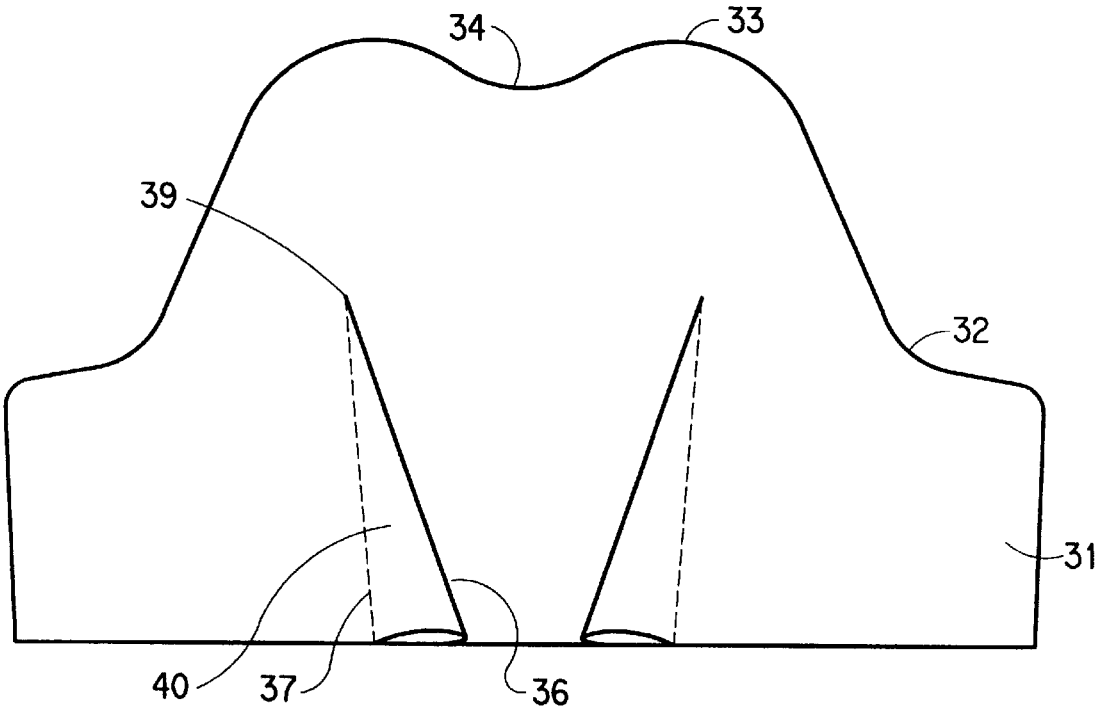
Figures 3, 4:
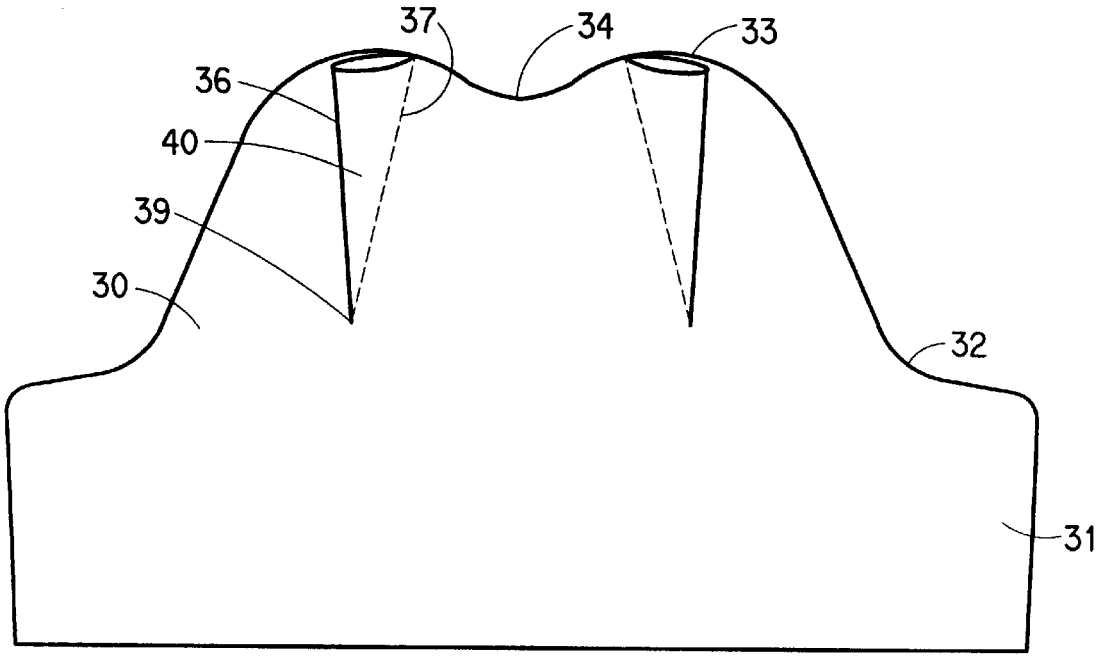
Figure 4:
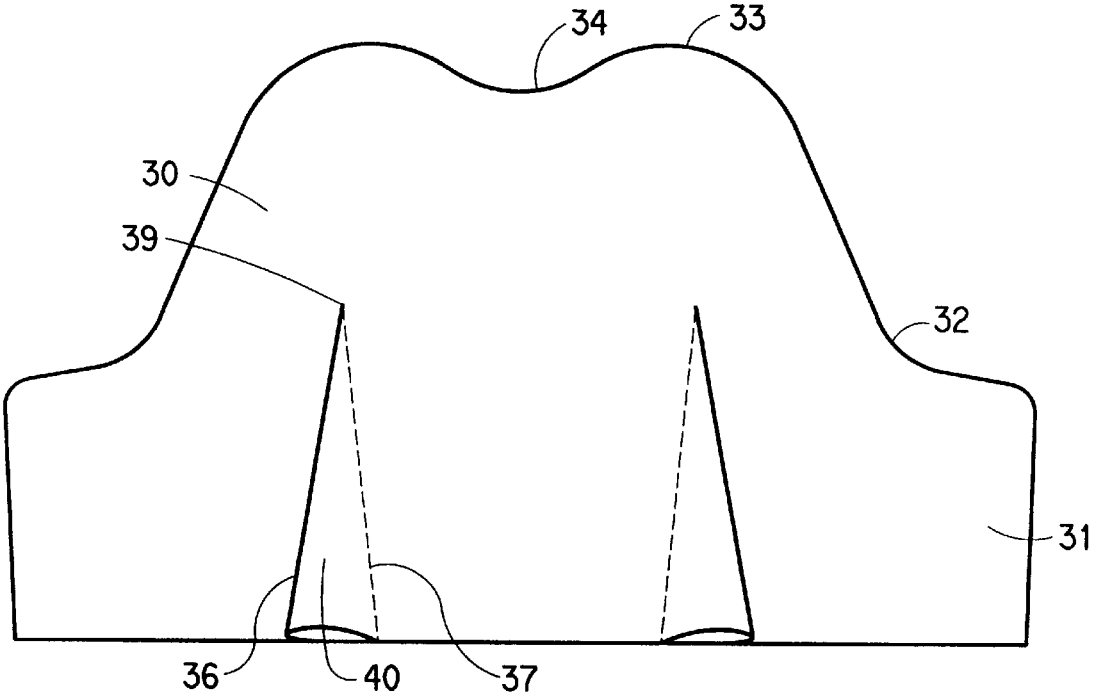
Figure 7:
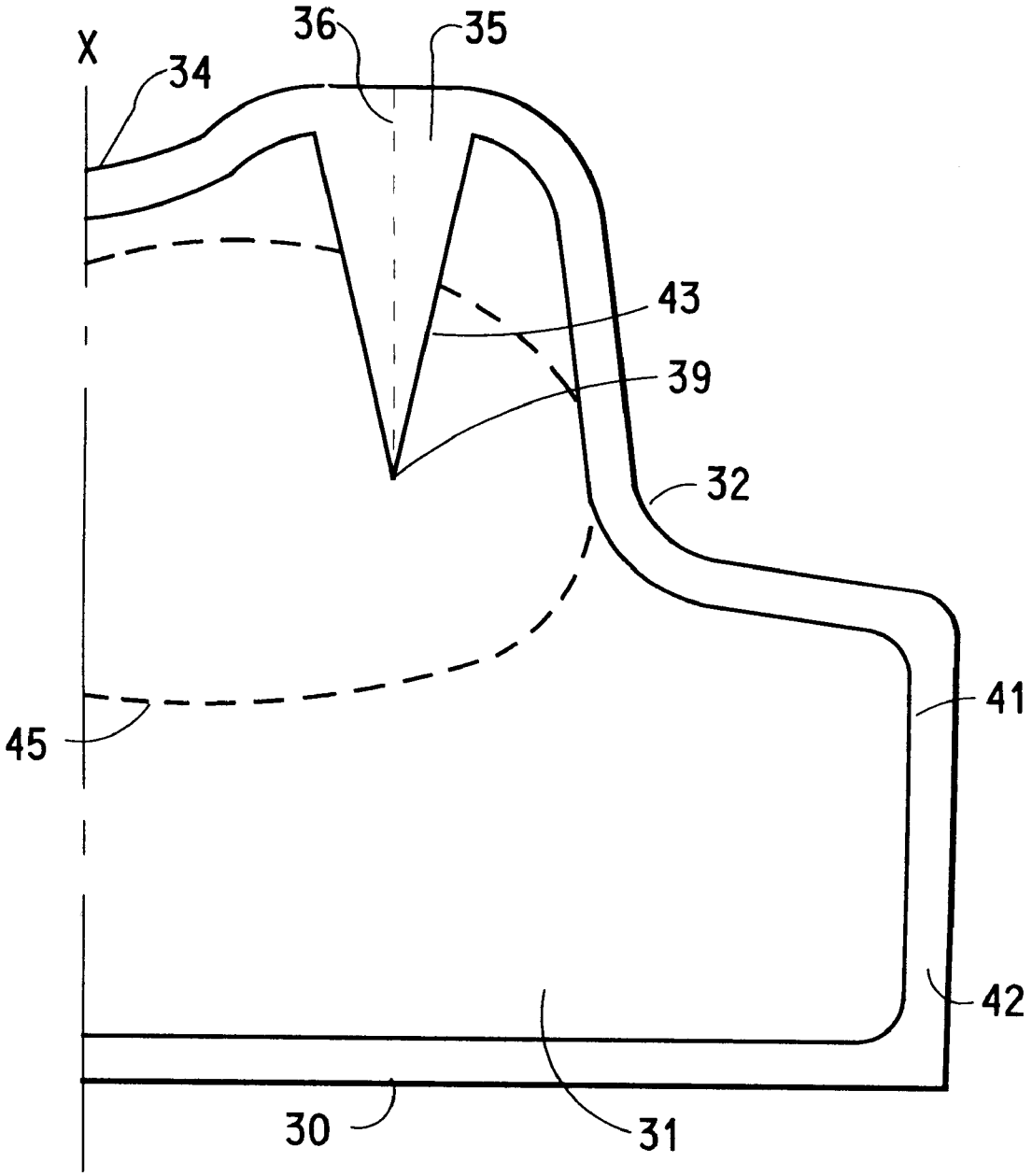

FIG. 7 illustrates a modified layer corresponding for example to that of FIG. 2-1, selectively coated with a reinforcing film.

As before, the layer 30 of penetration-resistant material has two side extensions 31, side recesses 32, rounded upper parts 33, and a concave top 34. Each half of the layer 30 also has a V-shaped section 35 having a central fold line 36 about which it can be folded and joined to form a dart as illustrated in FIG. 3, and as described above.

In this preferred embodiment of the invention, the layer 30 consists of a backing fabric of penetration-resistant material for instance made of aramid fibers which is coated or bonded or laminated to a reinforcing film 41, for instance an ionomeric polymer or another of the aforementioned polymers.

This film 41 extends over the main part of the fabric layer 30, in this example leaving free a peripheral strip 42 of several centimeters, to facilitate stitching together of the successive layers. Most importantly, the film 41 does not cover the V-shaped section 35 which consists solely of fabric which can easily be folded about line 36. The film 41 thus has edges 43 forming a V-shaped recess in the film and which, in this example are coincident with the fold lines 37 of FIG. 2.

When the dart is folded about line 36, as illustrated in FIG. 4-1, the folded layers of fabric of V-shaped section 35 come to overlay on the film 41 whose two edges 43 are brought together.

The darts can be folded on either side of the layer 30. When the darts are folded the edges 43 of film 41 come together. In a variation, the edges 43 of film 41 can be slightly spaced inside or outside the fold lines 37, so when the darts are folded the edges 43 overlap one another or remain slightly spaced apart which could facilitate stitching.

In another variation, a selected area 45, illustated in a broken line in FIG. 7, is coated with the reinforcing film. This area is chosen where protection is most needed for any particular application. The illustrated selected area 45 corresponds to the shaped part of the armor for receiving the breasts, i.e. where greatest protection is required.

In any event, when the darts are folded, the edges 43 of the reinforcing film 41 (which constitute a discontinuity in the film 41) are covered by the folded over layers of the section 35 of fabric forming the darts.

All or some of the layers as shown in FIGS. 2-1 to 2-12 can be made in the same fashion with a selectively applied reinforcing film, and the successive layers are assembled exactly as before, the peripheral fabric strip 42 being used to sew the layers together.

In the resulting panel, the angular offsetting of the darts distributes the darts, and the side-by-side edges 43 in the reinforcing film 41 of the different layers, to avoid bulges and excessive stiffness. Also the edges 43 forming discontinuities in the reinforcing film are angularly spaced apart from one another in the different layers, avoiding any deep area of weakness.

The resulting panel is found to provide improved penetration resistance to ballistic projectiles and improved stab resistance, even when only a few of the layers have a selectively-applied reinforcing film 41 (panel B in the following Examples). When a shaped vest panel is made up with all or substantially all of the layers provided with a selectively-applied reinforcing film 41 (panel C of the following Examples), the panel is found to have a greatly improved ballistic performance and outstanding resistance to stabbing, combined with excellent wearing comfort.

The invention will be further described in the following Examples.

EXAMPLE I

The shaped front panel of a bullet-resistant vest was manufactured as described above with 30 layers of Kevlar® Style 363F fabric sewed using 930 dtex Kevlar® sewing yarn. Kevlar® is a DuPont Registered Trademark. The layers were assembled on a bust measuring 94-64-97 cm (size 42). The finished shaped front panel was mounted on a Plastilina backing material and subjected to standard ballistic tests. Bullets were aimed at the tip, flank and border of the curved breast part under standard conditions. All bullets were stopped within the first half of the pack, which is an indication of good ballistic design. Moreover, the backface deformation on the Plastilina was satisfactory.

EXAMPLE II

A shaped front panel A of a bullet-resistant vest was manufactured as described in Example I with 32 layers of Kevlar® Style 363G fabric, 11×11 E/cm, 200 g/m$^2$ dry weight. The resulting vest panel was used for comparative ballistic and stab tests with the panels B and C of Example III and Example IV, as described below.

EXAMPLE III

A shaped front panel B of a bullet-resistant vest was manufactured as described in Example II with 26 layers of KEVLAR® Style 363G fabric, 11×11 E/cm, 200 g/m$^2$ dry weight, backed with three special backface sandwich assemblies. These backface assemblies were positioned at the inside of the vest, the side facing the wearer's body.

The special backface sandwich assemblies were produced as follows.

Two layers of KEVLAR® fabric and one layer of SURLYN® film 40 $\mu$m thick were marked and cut according to FIG. 2-1. Another two layers of KEVLAR® fabric and one layer of SURLYN® film 40 $\mu$m thick were marked and cut according to FIG. 2-2. Another two layers of KEVLAR® fabric and one layer of SURLYN® film 40 $\mu$ m thick were marked and cut according to FIG. 2-5.

In each case, the edge of the film was cut about 3 cm inside the edge of the fabric. Also, the area of the film corresponding to the V-shaped section for forming the dart was cut away according to the principle illustrated in FIG. 7.

Each layer of film was inserted between its two layers of fabric to form a sandwich which was molded for 15 minutes at 160° C. under a presssure of 10 bar.

The V-shaped parts of the three resulting sandwich assemblies, which were not covered by the film, were folded into darts as described previously, and assembled into a shaped backface assembly as described previously. This shaped backface assembly was then attached behind the 26 layers formed as described in Example I, by stitching the edge parts not covered with the film.

EXAMPLE IV

A shaped front panel C of a bullet-resistant vest was manufactured following the procedure described in Example I from 32 composite layers. Each composite layer was made of KEVLAR® fabric (Style 363G fabric, 11×11 E/cm, 200 g/m$^2$ dry weight) and one layer of SURLYN® film 40 $\mu$m thick.

The 32 fabric and film layers were marked and cut according to a pattern similar to that shown in FIGS. 2-1 to 2-12. In each case, the edge of the film was cut about 3 cm inside the edge of the fabric. Also, the areas of the films corresponding to the V-shaped sections for forming the darts were cut away according to the principle illustrated in FIG. 7.

Each film was placed on its corresponding fabric layer with the V-shaped cut-out parts of the film over the V-shaped parts of the fabric to be folded into darts, and molded for 15 minutes at 160° C. under a pressure of 10 bar, separately for each film/fabric assembly.

After, the darts were folded from the non-coated fabric in the V-shaped areas and stitched together, and the 32 composite molded layers were assembled and stitched together as described above.

BALLISTIC TESTS OF PANELS A, B AND C

The "mono-cup" body armor front panels A, B and C were filled with plastiline and subjected to standard ballistic tests by firing projectiles under controlled conditions. Shots were fired at six selected points on the shaped area, according to additional test requirements specified in the German Schutzklasse 1 standard, using 9 mm parabelum FMJ 8 g bullets. The comparative results are as follows:

Panel A showed an average value for backface deformation of 32.8 mm, the highest value being 42 mm;

Panel B showed an average value for backface deformation of 30.0 mm, the highest value being 38 mm; and Panel C showed an average value for backface deformation of 26.2 mm, the highest value being 35 mm.

Hence, panel B with additional backface protection showed improved ballistic performance, and panel C showed greatly improved ballistic performance.

STAB-RESISTANCE TESTS OF PANELS A, B AND C

The "mono-cup" body armor front panels A, B and C were filled with plastiline and subjected to standard stab-resistance tests using a blade fixed to a mass and dropped from a height corresponding to an energy of 10 Joules. The comparative results are as follows:

Panel A showed an average blade penetration into the plastiline of 23.1 mm, the highest value being 27 mm;

Panel B showed an average blade penetration into the plastiline of 21.9 mm, the highest value being 25 mm; and Panel C showed an average blade penetration into the plastiline of only 2.7 mm, the highest value being 5 mm.

Hence, panel B with additional backface protection showed improved stab resistance, and panel C showed outstanding stab resistance.

Panel C was slightly stiffer than panels A and B, but this did not detract from its wearing comfort. Moreover, the manufacture of panel C was simple. The molding process at 160° C. could be achieved easily, and the molded composites were easy to assemble thanks to the provision of V-shaped fabric areas non-covered by the protective film.

We claim:

1. Armor made of multiple layers of flexible relatively inelastic penetration-resistant material shaped to fit over a shaped area to be protected, wherein the layers are held by a plurality of darts in successive layers of the material, each of said layers of material having at least one dart and each dart in a layer comprising a generally V-shaped section whose edges are joined to form the dart, with the V-shaped section folded on itself and folded over to one side to form an added thickness overlaying or underlying an adjacent part of the layer, the darts in said multiple layers being angularly offset from one another with the folded V-shaped sections oriented so that said added thickness is distributed substantially evenly around said shaped area.

2. Multilayer shaped armor according to claim 1 in which the folded V-shaped sections are oriented in different directions.

3. Multilayer shaped armor according to claim 2 in which pairs of the layers of material have darts at the same angular location, with their folded V-shaped parts oriented in opposite directions so they do not overlay one another.

4. Multilayer shaped armor according to claim 3 in which the layers forming said pairs with darts at the same angular location are alternate layers.

5. Multilayer shaped armor according to claim 1 in which the darts extend radially from at least one point of convergence.

6. Multilayer shaped armor according to claim 5 in which the darts are angularly staggered from one another around a point of convergence by an angle which is equal to or greater than the angle of the V-shaped sections.

7. Multilayer shaped armor according to claim 1 which is body armor comprising at least one part shaped to fit over a shaped part of the body.

8. Multilayer shaped armor according to claim 7 which is shaped to fit over the bust of a female wearer, having two laterally-spaced internally concave recessed parts corresponding to the bust, in which the darts are angularly offset around each of the two laterally-spaced recessed parts about which said added thickness is distributed substantially evenly.

9. Multilayer shaped armor according to claim 8 in which said two laterally-spaced concave recessed parts corresponding to the bust are formed by darts around the upper, lower and outer edges of the recessed parts, defining a continuous shaped bust ("mono-cup") for receiving the two breasts.

10. Multilayer shaped armor according to claim 8 or 9 in which the darts extend radially from two laterally-spaced points of convergence corresponding to the centers of said recessed parts, the darts extending above and below the two points of convergence over an overall angle of at least about 180 degrees.

11. Multilayer shaped armor according to claim 1 in which the V-shaped sections each make an angle of 10 to 40 degrees.

12. Multilayer shaped armor according to claim 1 comprising darts in at least three angularly offset positions about a point of convergence.

13. Multilayer shaped armor according to claim 12 comprising darts in at least six angularly offset positions about a point of convergence.

14. Multilayer shaped armor according to claim 1 in which the layers of penetration-resistant material comprise polyaramid fibers.

15. Multilayer shaped armor according to claim 1 in which at least one of the layers of penetration-resistant material comprises a fabric bonded to or coated with a reinforcing continuum.

16. Multilayer shaped armor according to claim 15 in which the reinforcing continuum extends over a selected area to be protected of said at least one layer, with the exception of the or each folded-over V-shaped section forming the or each dart, said folded-over V-shaped section consisting of fabric only.

17. Multilayer shaped armor according to claim 16 in which there are discontinuities in the reinforcing continuum in the area of the folded over darts, said discontinuities being covered by the folded over layers of the fabric forming the darts, the angular offsetting of said darts distributing the darts and said discontinuities in the reinforcing continuum of the different layers to avoid bulges and excessive stiffness.

18. Multilayer shaped armor according to claim 16 in which said reinforcing continuum is a polymeric film or coating layer, a metal foil or a sheet of rubber or elastomer.

19. Multilayer shaped armor according to claim 1 in which at least two successive layers of penetration-resistant material are glued or bonded together as a sandwich.

20. A method of manufacturing multilayer shaped armor as defined in claim 1, comprising:

providing multiple layers of flexible relatively inelastic penetration-resistant material to be assembled into the shaped armor, each layer having fold lines defining at least one dart comprising a generally V-shaped section of the material, the darts of the different layers being angularly offset from one another around at least one point of convergence;

joining the edges of the V-shaped sections to form the dart(s) in each layer, the layers with formed darts all having substantially the same peripheral shape for assembly into the shaped armor;

assembling the multiple layers to form the shaped part, with darts of different layers angularly offset to one another and with the V-shaped sections of material folded in directions to distribute the added thickness substantially evenly; and attaching the shaped multiple layers to form the armor.

21. The method according to claim 20 in which pairs of the layers of material have darts at the same angular location, the V-shaped sections of these layers being folded in opposite directions so they do not overlay one another.

22. The method according to claim 20 in which the pairs of layers with darts at the same angular location are assembled in alternate layers.

23. The method according to claim 20 in which at least one of the layers of penetration-resistant material comprises a fabric bonded to or coated with a reinforcing continuum which extends over a selected area to be protected of said at least one layer with the exception of the or each folded-over V-shaped section forming the or each dart, said folded-over V-shaped section consisting of fabric only.

24. The method according to claim 23 in which the reinforcing continuum is applied to the fabric, with the application of heat and pressure, before folding the darts.

25. The method according to claim 23 in which the reinforcing continuum is applied to the fabric after folding of the dart(s).

26. The method of claim 23 in which a peripheral edge part of the fabric is free from the reinforcing continuum, and the successive layers are joined by sewing around said peripheral edge part of the fabric.

27. The method according to claim 20, 21 or 22 in which the edges of the V-shaped sections are joined to form the darts by sewing, stapling, riveting or gluing.

28. The method according to claim 20 in which the darts are folded and joined before assembling the multiple layers.

29. The method according to claim 20 in which several layers are preassembled before the darts therein are folded, followed by folding darts from the individual assembled layers or folding a single dart from several layers to shape the assembly.

* * * * *